US006806237B2

(12) United States Patent
O'Rear

(10) Patent No.: US 6,806,237 B2
(45) Date of Patent: Oct. 19, 2004

(54) LUBE BASE OILS WITH IMPROVED STABILITY

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/966,298

(22) Filed: Sep. 27, 2001

(65) Prior Publication Data

US 2003/0100453 A1 May 29, 2003

(51) Int. Cl.[7] ..... C10M 111/00; C10M 171/00
(52) U.S. Cl. ..... 508/110; 585/1; 208/19
(58) Field of Search ..... 508/110; 585/1

(56) References Cited

U.S. PATENT DOCUMENTS

| | | | | |
|---|---|---|---|---|
| 3,852,207 A | | 12/1974 | Stangeland et al. | |
| 4,385,984 A | | 5/1983 | Bijwaard et al. | |
| 5,096,883 A | | 3/1992 | Mercer et al. | |
| 5,143,702 A | | 9/1992 | Der et al. | |
| 5,362,375 A | | 11/1994 | Kubo et al. | |
| 5,393,408 A | | 2/1995 | Ziemer et al. | |
| 5,622,924 A | | 4/1997 | Sakai et al. | |
| 5,833,839 A | * | 11/1998 | Wittenbrink et al. | 208/112 |
| 5,906,727 A | * | 5/1999 | Wittenbrink et al. | 208/14 |
| 5,993,644 A | | 11/1999 | Xiao et al. | |
| 6,008,164 A | | 12/1999 | Aldrich et al. | |
| 6,080,301 A | * | 6/2000 | Berlowitz et al. | 208/18 |
| 6,096,690 A | * | 8/2000 | Wittenbrink et al. | 507/103 |
| 6,165,949 A | * | 12/2000 | Berlowitz et al. | 508/363 |
| 6,180,842 B1 | * | 1/2001 | Berlowitz et al. | 585/1 |
| 6,245,719 B1 | * | 6/2001 | Kobori | 508/110 |
| 6,332,974 B1 | * | 12/2001 | Wittenbrink et al. | 208/18 |
| 6,420,618 B1 | * | 7/2002 | Berlowitz et al. | 585/310 |

FOREIGN PATENT DOCUMENTS

| | | |
|---|---|---|
| GB | 2024852 | 1/1980 |
| GB | 2134538 A | 8/1984 |
| WO | WO 00/11117 | 3/2000 |
| WO | WO 00/14179 | 3/2000 |
| WO | WO 00/14188 | 3/2000 |
| WO | WO 00/15736 | 3/2000 |
| WO | 02/083826 A1 | 10/2002 |

OTHER PUBLICATIONS

United Kingdom Search Report dated Mar. 26, 2003.
Altget, Klaus H., *Composition and Analysis of Heavy Petroleum Fractions*, 1994, Table of Contents, Marcel Dekker Inc., 270 Madison Ave., New York, New York 10016.
Dornte, R.W., *Oxidation of White Oil, Industrial and Engineering Chemistry*, Industrial Edition, Jan. 1936, vol. 28, No. 1, Published by American Chemical Society, Easton PA. pp. 26–30.
Kurz, German & Teuner, Stefan, "Calcor Process for CO Production", *Energietechnik*, Erdöl und Kohle–Erdgas–Petrochemie vereinigt mit Brennstoff–Chemie, Bd 43,603 Heft 5, May 1990.

* cited by examiner

*Primary Examiner*—Ellen M. McAvoy
(74) *Attorney, Agent, or Firm*—Burns, Doane, Swecker & Mathis, L.L.P.

(57) ABSTRACT

A lube base oil comprising a synthetic lube base oil, such as a Fischer Tropsch-derived component, and a non-synthetic lube base oil is defined that has improved stability to oxidation both during storage and during use in engines or other applications, even in the substantial absence of antioxidant additives and oxidation promoters.

14 Claims, 2 Drawing Sheets

LUBE BASE OILS WITH IMPROVED STABILITY

FIELD OF THE INVENTION

The invention relates to a blend of lube base oils which provides improved oxidation stability, both with additives and without additives.

BACKGROUND OF THE INVENTION

Finished lubricants used for automobiles, diesel engines, and industrial applications consist of two general components: a lube base oil and additives. In general, a few lube base oils are used to generate a wide variety of finished lubricants by varying the mixtures of individual lube base oils and individual additives. This requires that lube base oils be stored without additives prior to use. Also, lube base oils are an item of commerce and are bought, sold and exchanged. Since the receiver of the lube base oil wants to formulate specific finished lubes, they do not want to receive lube base oils that already contain additives. Thus, lube base oils in almost all circumstances do not contain additives, and are simply hydrocarbons prepared from petroleum or other sources. Thus one general requirement for a lube base oil is that it have good stability during shipment and storage in the absence of additives. In addition, it is desirable that the finished lubricant have as good a stability as possible. In this case, the stability is the resistance to oxidation and formation of deposits during shipment and storage in the presence of additives and other compounds that simulate use in commercial equipment. The preferred lube base oil is one that has a combination of good stability without additives and with additives.

Thus, there is a need in the art for a lube base oil that has good stability both with and without additives. There is further a need in the art for a way to make this improved lube base oil from supplies of lube base oil that are generally deficient in at least one measure of stability. Moreover, there is a need in the art for such a lube base oil that can provide good stabilities without the need for special additives. This invention provides such a lube base oil.

SUMMARY OF THE INVENTION

The present invention is directed to lube base oils with improved stability against oxidation. In particular, the lube base oil product of one embodiment of the invention is a blend of a synthetic lube base oil and a non-synthetic lube base oil wherein the lube base oil product has a greater stability in the absence of additives than the stability of the synthetic lube base oil and has a greater stability in the presence of additives than the non-synthetic lube base oil.

A lube base oil according to the invention comprises at least one synthetic lube base oil having an iso-paraffin content greater than 50%; and at least one percent of a non-synthetic lube base oil selected from the groups consisting of Group I lube base oils, Group II lube base oils with a sulfur content greater than about 50 ppm, petroleum-derived Group V lube base oils, or mixtures thereof. Preferably, the synthetic lube base oil will have an Oxidator A value in the absence of additives less than about 1 and the non-synthetic lube base oil will have an Oxidator A value in the absence of additives greater than about 5. In one embodiment of the invention, the synthetic lube base oil is obtained from a Fischer Tropsch process.

In another embodiment of the invention, a lube base oil is provided comprising at least one synthetic lube base oil having a sulfur content less than about 50 ppm and at least one percent of a non-synthetic lube base oil having a sulfur content greater than about 300 ppm and selected from the groups consisting of Group I lube base oils, petroleum-derived Group V lube base oils, or mixtures thereof. Preferably, the synthetic lube base oil will have an Oxidator A value less than about 1 and the non-synthetic lube base oil will have an Oxidator A value greater than about 5.

In another embodiment of the invention, a lube base oil is provided comprising at least one synthetic lube base oil having an Oxidator A value in the absence of additives of less than about 1 and an Oxidator BN value in the presence of additives greater than about 7; and a non-synthetic lube base oil having an Oxidator A value in the absence of additives greater than about 5 and an Oxidator BN value in the presence of additives less than about 10.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
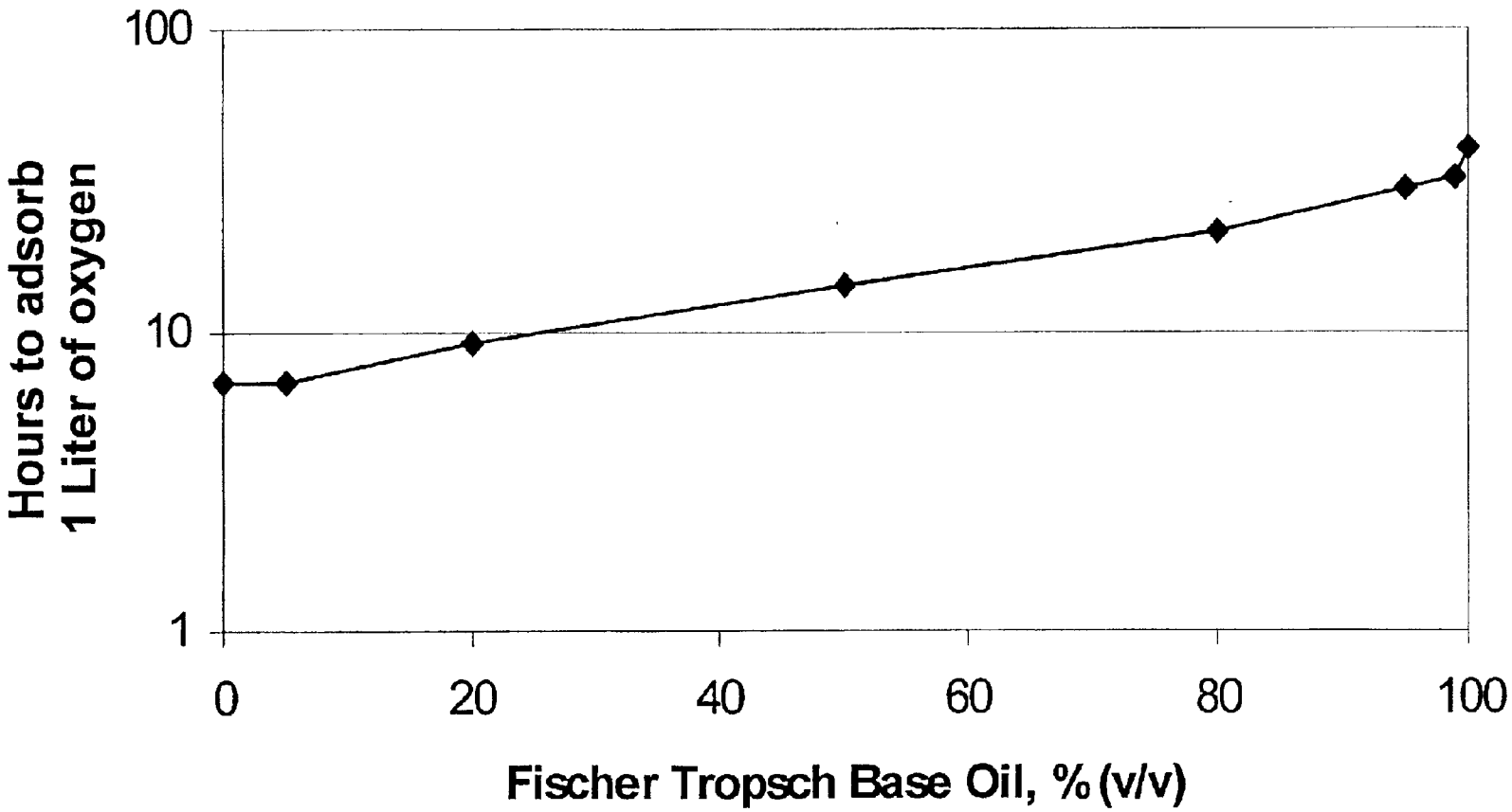
FIG. 1 is a graphical representation of the oxidation stability of lube base oil blends containing both metal promoters and antioxidants as described in Example 1.

The lube base oils of the present invention provide oxidation stability. This ability to resist the natural degradation of petroleum products upon contact with oxygen is an important property for lube base oils which need to be stable both without additives and with additives once prepared for a particular use.

The following definitions will be used throughout this application:

The term "lube base oil" as used herein refers to a material following the American Petroleum Institute Interchange Guidelines (API Publication 1509).

The term "lube base stock" refers to hydrocarbons in the lube base oil range that have acceptable viscosity index and viscosity for use in making finished lubes. Lube base stocks are mixed with additives to form finished lubes.

The term "base stock" as used herein refers to a lubricant component that is produced by a single manufacturer to the same specifications, independent of feed source or manufacturer's location and that meets the same manufacturer's specifications. The base stock generally is identified by a unique formula, product identification number or both. Base stocks may be manufactured using a variety of different processes including but not limited to distillation, solvent refining, hydrogen processing, oligomerization, esterification, and refining. Rerefined stocks shall be substantially free from materials introduced through manufacturing, contamination or previous use.

A base stock slate as used herein is a product line of base stocks that have different viscosities but are the same base stock grouping and from the same manufacturer.

A base oil is the base stock or blend of base stocks used in an API-licensed oil.

The term "petroleum-derived Group V lube base oil" as used herein means a material made according to Group V of the API Interchange Guidelines with a VI below 80 and prepared from petroleum typically by processes used to make Group I or II lube base oils. For purposes of this application, petroleum-derived Group V lube base oils exclude silicon and ester lubricants.

The term "shipping" as used herein refers to transportation of the lube base oil by any of the following means: marine tanker, rail car, truck, barge, pipeline, or combinations thereof.

The term "storage" as used herein refers to storage in any form of tank, floating or fixed roof, or in a transportation vessel, or in drums, can or jars.

The term "finished lubricant" as used herein is a blend of at least one lube base oil and at least one additive.

The term "iso-paraffin content" as used herein refers to the concentration of iso-paraffins in a sample. Iso-paraffins are defined as branched alkanes, and do not include normal alkanes and cycloalkanes. For lube base oils, which have had olefin and oxygenate impurities from Fischer Tropsch products removed, the concentration of iso-paraffins can be determined by determining the total paraffin content by use of mass spectroscopic methods and the concentration of normal paraffins, which is usually very small for lube base oils with acceptable pour points, can be determined by gas chromatography. The concentration of iso-paraffins is found by the difference. References for these and other methods to measure iso-paraffins are found in Klaus H. Altgelt and Mieczyslaw M. Boduszynski, "Composition and Analysis of Heavy Petroleum Fractions," Marcel Decker Publishers, 1994. A lube base oil with a high isoparaffin content is expected to have a good resistance to oxidation in the presence of additives, but likely a poor resistance to oxidation in the absence of additives.

The term "viscosity index" refers to the measurement defined by D 2270-93.

The term "synthetic lube base oil" as used herein refers to oil produced by chemical synthesis rather than by extraction and refinement from crude petroleum oil. For the purposes of the this application, this means a material meeting the API Interchange Guidelines but prepared by any of the following processes: Fischer Tropsch synthesis, ethylene oligomerization, normal alpha olefin oligomerization, and oligomerization of olefins boiling below C10. This excludes silicon and ester lubricants.

The term "syngas" as used herein means a mixture that includes both hydrogen and carbon monoxide. In addition to these species, water, carbon dioxide, unconverted light hydrocarbon feedstock and various impurities may also be present.

The specifications for lube base oils are defined in the API Interchange Guidelines (API Publication 1509).

| Group | Sulfur, ppm | And/or | Saturates, % | Viscosity Index |
|---|---|---|---|---|
| I | >300 | | <90 | 80–120 |
| II | <300 | | >90 | 80–120 |
| III | <300 | | >90 | >120 |
| IV | All Polyalphaolefins | | | |
| V | All Stocks Not Included in Groups I–IV | | | |

Plants that make Group I base oils typically use solvents to extract the lower VI (viscosity index) components and increase the VI of the crude to the specifications desired. These solvents are typically phenol or furfural. Solvent extraction gives a product with less than 90% saturates and more than 300 ppm sulfur. The majority of the lube production is in the Group I category.

Plants that make Group II base oils typically employ hydroprocessing such as hydrocracking or severe hydrotreating to increase the VI of the crude to the specification value. The use of hydroprocessing typically increases the saturate content above 90 and reduces the sulfur below 300 ppm. Approximately 10% of the lube base oil production in the world is in the Group II category. About 30% of U.S. production is Group II.

Plants that make Group III base oils typically employ wax isomerization technology to make very high VI products. Since the starting feed is waxy VGO or wax which contains all saturates and little sulfur, the Group III products have saturate contents above 90 and sulfur contents below 300 ppm. Fischer Tropsch wax is an ideal feed for a wax isomerization process to make Group III lube oils. Only a small fraction of the world's lube supply is in the Group III category.

Group IV lube base oils are derived by oligomerization of normal alpha olefins and are called polyalphaolefin (PAO) lube base oils. Group V lube base oils are all others. This group includes synthetic esters, silicon lubricants, halogenated lube base oils and lube base oils with VI values below 80. The latter can be described as petroleum-derived Group V lube base oils. Petroleum-derived Group V lube base oils typically are prepared by the same processes used to make Group I and II lube base oils, but under less severe conditions.

A convenient way to measure the stability of lube base oils is by the use of the Oxidator Test, as described by Stangeland et al. in U.S. Pat. No. 3,852,207. There are two forms of this test: Oxidator BN and Oxidator A. The Oxidator BN measures the response of a lubricating oil in a simulated application which includes both typical antioxidant additives and metal oxidation promoters that are typically found in finished lubricants during use. The Oxidator A test is conducted in the same fashion, except both the antioxidant additives and the metal oxidation promoters are omitted. The Oxidator BN text is a measure of the oxidation stability during use, and the Oxidator A test is a measure of oxidation stability during shipping and storage.

The Oxidator BN test referred to above is a test measuring resistance to oxidation by means of a Dornte-type oxygen absorption apparatus (R. W. Dornte "Oxidation of White Oils," Industrial and Engineering Chemistry, Vol. 28, page 26, 1936). Normally, the conditions are one atmosphere of pure oxygen at 340° F., and one reports the hours to absorption of 1000 ml of $O_2$ by 100 g. of oil. In the Oxidator BN test, 0.8 ml of catalyst is used per 100 grams of oil and an additive package is included in the oil. The catalyst is a mixture of soluble metal-naphthenates simulating the average metal analysis of used crankcase oil. The additive package is 80 millimoles of zinc bispolypropylenephenyldithiophosphate per 100 grams of oil. The Oxidator BN measures the response of a lubricating oil in a simulated application. High values, or long times to adsorb one liter of oxygen, indicate good stability. Generally, the Oxidator BN should be above about 7 hours. Preferably, the Oxidator BN value will be greater than about 10 hours. As used herein, the phrase "Oxidator BN value in the presence of additives" and similar statements mean the additive packages described which is used for conducting the Oxidator BN test.

The Oxidator A test uses the same apparatus as in the Oxidator BN test. The difference is that the catalyst and additive package are omitted. Thus the Oxidator A test is a measure of the oxidation stability of the original lubricating base oil during storage. High values indicating the time it takes to adsorb one liter of oxygen demonstrates good stability. Values of Oxidator A in excess of one hour are desired, with a value in excess of about five hours preferred and an value of greater than about 10 hours most preferred. As used herein, the phrase "Oxidator A value in the absence of additives" refers to the performance of the Oxidator A test without an additive package as utilized in the Oxidator BN test.

In addition to the Oxidator A and BN tests which measure the uptake of oxygen, another method to study the stability of lube base oils during storage is to monitor floc and sediment formation when they are stored in an oven while exposed to air. This simulates storage in heated tanks that are commonly used in lube base oil storage and transport. Fifty grams of the oil is placed in a loosely capped 7 ounce bottle and placed in an oven at 150° F. The sample is inspected periodically for an increase in color, or formation of floc or sediments. Formation of floc or sediment is considered unacceptable, and the time at which this happens is considered as the failure point. The test is run for 90 days, a typical time in transit when consideration is given for mixing of lube base oils in storage tanks. An acceptable material will not fail within 90 days.

A problem may be created when Group II lube base oils with a sulfur content below about 50 ppm and Group III lube base oils are considered for storage and transportation. These base oils may contain very low levels of sulfur. Sulfur is a natural antioxidant and imparts an improved stability to a typical lube base oil. This effect has been known for some time, for example von Fuchs and Diamond, In. Eng. Chem., 34:927 (1942). When the sulfur is very low, for example, less than 200 ppm, preferably, less than 50 ppm, and most preferably less than 10 ppm, the oil can have an unacceptable stability during shipping and storage in the absence of additives. A general feature of Group II and III lube base oils is that they have excellent stabilities during use in finished lubricants, as measured by the Oxidator BN test, due to the high levels of saturates. However, the lube base oils can have poor stability during shipping and storage, as measured by the Oxidator A test, due to low levels of sulfur. This situation is even more pronounced when lube base oils are made by the Fischer Tropsch process. Since this process uses reforming and hydrocarbon synthesis catalysts that are poisoned by sulfur, great efforts are conducted to remove sulfur from the feedstocks. Thus the products often have very low levels of sulfur, for example, less than 50 ppm and preferably less than 10 ppm. This composition often gives lube base oils made by the Fischer Tropsch process which have excellent Oxidator BN stabilities but poor Oxidator A stabilities.

In contrast, Group I lube base oils have high levels of sulfur, and lower levels of saturates. Petroleum-derived Group V lube base oils may exhibit these characteristics also. The Group I and petroleum-derived Group V lubes base oils typically show the reverse pattern of stabilities in that they have moderate or poor Oxidator BN stabilities and good Oxidator A stabilities.

The present invention provides lube base oils with combined good Oxidator A and Oxidator BN stabilities. It has remarkably been discovered that these lube base oils can be prepared by blending lube base oils that have poor Oxidator A stabilities but good Oxidator BN stabilities with lube base oils that have the opposite properties such as good Oxidator A stabilities but poor Oxidator BN stabilities. Surprisingly, the Oxidator A and BN values do not blend linearly, and lube base oils made by blending these components have properties superior to either individual base oil.

The lube base oils that have poor Oxidator A stabilities and good Oxidator BN stabilities for use in one embodiment of the present invention may be selected from any of the Group II lube base oils with a sulfur content less than about 50 ppm and Group III lube base oils. Generally, these lube base oils will have relatively low sulfur content, typically, less than or equal to about 0.03% sulfur. Group II lube base oils which have greater than about 50 ppm may have satisfactory Oxidator A stability, or Oxidator A values greater than about 1.

In one embodiment, the lube base oils may be any synthetic lube base oil having an iso-paraffin content greater than about 50%. In a more preferred embodiment, the iso-paraffin content of the synthetic lube base oil will be greater than about 75% and most preferably greater than about 90%.

In a further embodiment of the invention, the lube base oils are synthetic lube base oils obtained from the Fischer-Tropsch process. In Fischer-Tropsch chemistry, synthetic gas, or syngas, CO and $H_2$, is converted to liquid and solid hydrocarbons by contact with a Fischer-Tropsch catalyst under suitable temperature and pressure reactive conditions. Methane (and/or ethane and heavier hydrocarbons) can be sent through a conventional syngas generator to provide synthesis gas. Typically, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guardbeds are preferred for removing sulfur impurities. Means for removing other contaminants are well known to those of skill in the art.

Examples of conditions for performing Fischer-Tropsch type reactions are well known to those of skill in the art. The reaction is typically conducted at temperatures of about from 300 to 700° F. (149 to 371° C.) preferably about from 400° to 550° F. (204° to 228° C.); pressures of about from 10 to 500 psia, (0.7 to 34 bars) preferably 30 to 300 psia, (2 to 21 bars) and catalyst space velocities of about from 100 to 10,000 cc/g/hr., preferably 300 to 3,000 cc/g/hr. The reaction can be conducted in a variety of reactors for example, fixed bed reactors containing one or more catalyst beds, slurry reactors, fluidized bed reactors, or a combination of different type reactors. The products may range from C1 to C100+ with a majority in the C5–C100+ range.

Thus, the term Fischer-Tropsch type product or process is intended to apply to Fischer-Tropsch processes and products and the various modifications thereof and the products thereof.

The lube base oils that have good Oxidator A stabilities and poor Oxidator BN stabilities for use in the present invention may be selected from any of the Group I or petroleum-derived Group V lube base oils. In one embodiment, Group II lube base oils having a sulfur content greater than about 50 ppm may also be used since there are lube base oils from this group with higher levels of sulfur which have adequate Oxidator A values. In particular, the lube base oils from Group I oils may be non-synthetic or obtained from extraction and refinement from crude petroleum oil rather than from chemical synthesis. Preferred lube base oils from Group I oils are those that contain relatively high levels of sulfur. More particularly, these lube base oils may be Group I lube base oils with a sulfur content greater than about 300 ppm. In a preferred embodiment, the Group I lube base oil will have a sulfur content greater than about 700 ppm.

The exact proportions to be used in the blend of the invention depend on the compositions of the two blending streams. Since two base oils are blended, the resulting product can also be considered a base oil by the API Guidelines. In a preferred embodiment, the lube base oils will be blended such that the final base oil will contain about 20% to about 99.9% of synthetic lube base oil and about 0.1% to about 80% non-synthetic lube base oil. Preferably, the lube base oil of one embodiment of the invention will have about 70 to about 99% of synthetic lube base oil and about 1 to about 30% of non-synthetic lube base oil.

The viscosity of the lube base oil of the invention will be above about 3 cSt at 40° C., preferably between about 3 and about 500 cSt at 40° C. The desired viscosity will depend on the final use of the lube base oil and the additives which will be utilized to obtain a finished lubricant product.

The lube base oil of the present invention may be used in a finished lubricant composition and, thus, may contain one or more additives, depending on the particular use of the oil. It has been found that the blending of oils according to this invention provides a composition that has good stability with or without the use of additives. However, final users of such oils may desire certain additives for a particular end use. These additives are known to those of skill in the art. For example, these additives may include detergents, dispersants, antioxidants, antiwear additives, pour point depressants, VI improvers, friction modifiers, demulsifiers, antifoamants, or corrosion inhibitors, among others. Generally, the additives will be anti-wear, pour point depressants, and detergents. The additives will be used in amounts which are known to those of skill in the art, preferably about 0.1 to about 40 wt% of the final lube oil product.

The invention will be further illustrated by following examples, which set forth particularly advantageous method embodiments. While the Examples are provided to illustrate the present invention, they are not intended to limit it.

EXAMPLES

Two lube base oils were obtained. One of the oils was obtained from a Fischer Tropsch process and the other was a conventional Group I base oil from the Exxon Corporation. The properties of these base oils are shown in Table I.

TABLE I

| | Fischer Tropsch 8cSt Base Oil | Exxon 330 SN |
|---|---|---|
| API Gravity | 39.5 | 29.4 |
| S, ppm | | >1000 |
| N, ppm | | 65 |
| Est. iso-paraffin content, wt % | >95 | |
| 1 ring aromatic compounds, wt % | 0.042 | 23.234 |
| 2 ring aromatic compounds, wt % | 0 | 4.263 |
| 3 ring aromatic compounds, wt % | 0 | 0.475 |
| 4 ring aromatic compounds, wt % | 0 | 0.04 |
| 6 ring aromatic compounds, wt % | 0 | 0 |
| Total aromatic compounds, wt % | 0.042 | 28.012 |
| VI | 159 | 100 |
| Vis @ 100° C., cSt | 7.948 | 8.489 |
| Vis @ 40° C., cSt | 42.93 | 65.29 |
| Flash Point, ° C. | | 216 |
| Density | 0.824 | |
| MW | 570 | |
| RI @ 20° C. | 1.46 | |
| Specific Gravity @ 60° C. | | 0.88 |
| Aniline Point, F | | 226.2 |
| Cloud, ° C. | 9 | −11 |
| Pour, ° C. | −20 | −12 |
| D-2887 Simulated TBP (WT %), ° F. | | |
| TBP @ 0.5 | | 507 |
| TBP @ 5 | | 712 |
| TBP @ 10 | | 753 |
| TBP @ 20 | | 802 |
| TBP @ 30 | | 834 |
| TBP @ 50 | | 884 |
| TBP @ 70 | | 934 |
| TBP @ 90 | | 996 |
| TBP @ 95 | | 1017 |
| TBP @ 99.5 | | 1067 |

Figure 2:
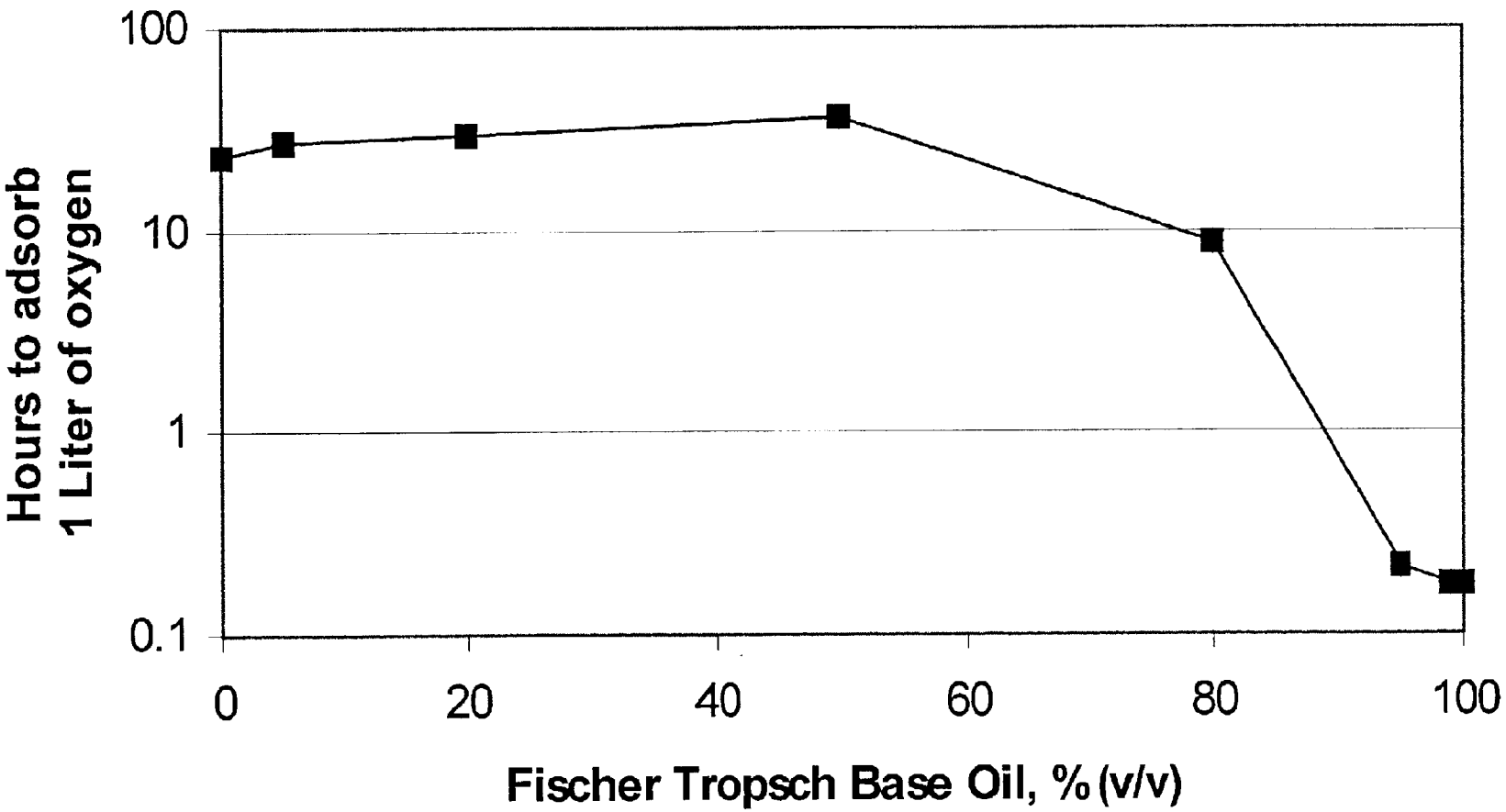
FIG. 2 is a graphical representation of the oxidation stability of lube base oil blends without metal promoters or antioxidants as described in Example 1.

Blends of the two lube base oils were prepared and evaluated in the Oxidator A and BN tests with the following results. High values, long times to adsorb 1 liter of oxygen, indicate good stability. Values of Oxidator BN in excess of 7 hours are desired, preferably in excess of 10 hours. Values of Oxidator A in excess of one hour are desired, preferably in excess of five hours and most preferably in excess of 10 hours. FIG. 1 presents a graphical representation of the oxidation stability for the blends of Fischer-Tropsch base oil and the conventional base oil with metal promoters and antioxidants added. FIG. 2 presents a graphical representation of the oxidation stability for the blends with no metal promoters or antioxidants present. Table II shows the volume % and weight % of each base oil and the results of the Oxidator A, Oxidator BN and oven storage tests obtained from each blend.

TABLE II

| | | | | | | | | |
|---|---|---|---|---|---|---|---|---|
| Vol % Fischer-Tropsch Base Oil | 0 | 5 | 20 | 50 | 80 | 95 | 99 | 100 |
| Vol % Conventional Base Oil | 100 | 95 | 80 | 50 | 20 | 5 | 1 | 0 |
| Wt. % Fischer-Tropsch Base Oil | 0.0 | 4.7 | 19.0 | 48.5 | 79.0 | 94.7 | 98.9 | 100.0 |
| Wt. % Conventional Base Oil | 100.0 | 95.3 | 81.0 | 51.5 | 21.0 | 5.3 | 1.1 | 0.0 |

TABLE II-continued

| | | | | | | | | |
|---|---|---|---|---|---|---|---|---|
| API of Blend | 29.4 | 29.9 | 31.3 | 34.3 | 37.4 | 39.0 | 39.4 | 39.5 |
| Oxidator A, hours | 23.24 | 27.48 | 29.82 | 36.38 | 8.58 | 0.22 | 0.18 | 0.18 |
| Oxidator BN, hours | 6.78 | 6.62 | 9.10 | 14.26 | 21.20 | 30.11 | 31.96 | 40.64 |
| Oven Storage life at 150° F., days | 90+ | 90+ | 90+ | 90+ | 90+ | 90+ | 90+ | 70 |

Both oxidation stability results vary significantly as shown graphed on logarithmic paper on FIG. 1 and FIG. 2. Adding 20% of the conventional base oil to the Fischer-Tropsch base oil increased the Oxidator A stability by over one and almost two orders of magnitude. Blends containing between 5 and 50% by volume of the Fischer-Tropsch base oil also had better Oxidator A stabilities than the conventional base oil.

The data shows that certain blends can have an unexpected simultaneous increase in both the stability without additives and with additives. The compositions of the blend that give this improvement will depend on the nature of the individual base stocks.

The sample of Fischer-Tropsch base oil only formed sediment at 70 days in the test and failed. The conventional base oil and all blends of base oil with the Fischer-Tropsch base oil passed the test. This demonstrates that adding only one volume percent of a conventional base oil to a Fischer-Tropsch base oil can make a material with a satisfactory storage stability from one that otherwise would not have had satisfactory stability. In all likelihood, depending on the materials used, even smaller amounts can be effective in improving the storage stability. While the present invention has been described with reference to specific embodiments, this application is intended to cover those various changes and substitutions that may be made by those skilled in the art without departing from the spirit and scope of the appended claims.

What is claimed is:

1. A lube base oil comprising:

a) at least one synthetic lube base oil having an iso-paraffin content of greater than 50% and an Oxidator A value of less than about 1; and b) at least one percent of a non-synthetic lube base oil selected from the groups consisting of Group I lube base oils, Group II lube base oils with a sulfur content greater than about 50 ppm, petroleum-derived Group V lube base oils, or mixtures thereof wherein the non-synthetic lube base oil has an Oxidator BN value of less than about 7;

wherein the lube base oil has an Oxidator A value of greater than about 1 and has an Oxidator BN value of greater than about 7.

2. A lube base oil according to claim 1 wherein the synthetic lube base oil is prepared by a Fischer Tropsch process.

3. A lube base oil according to claim 1 wherein the synthetic lube base oil is present in an amount of about 20 to about 80% by volume.

4. A lube base oil comprising:

a) at least one synthetic lube base oil having a sulfur content less than about 50 ppm and an Oxidator A value of less than about 1; and b) at least one percent of a non-synthetic lube base oil having a sulfur content greater than about 300 ppm and selected from the groups consisting of Group I lube base oils, petroleum-derived Group V lube base oils, or mixtures thereof wherein the non-synthetic lube base oil has an Oxidator BN value of less than about 7;

wherein the lube base oil has an Oxidator A value of greater than about 1 and has an Oxidator BN value of greater than about 7.

5. A lube base oil according to claim 4 wherein the synthetic lube base oil is prepared by a Fischer Tropsch process.

6. A lube base oil according to claim 4 wherein the non-synthetic lube base oil has a sulfur content greater than about 700 ppm.

7. A lube base oil according to claim 4 wherein the synthetic lube base oil has an Oxidator BN value of greater than 7.

8. A lube base oil according to claim 7 wherein the synthetic lube base oil has an Oxidator BN value of greater than 10.

9. A lube base oil according to claim 4 wherein the non-synthetic lube base oil has an Oxidator A value of greater than about 5.

10. A lube base oil comprising:

a) at least one synthetic lube base oil having an Oxidator A value of less than about 1 and an Oxidator BN value of greater than about 7; and b) a non-synthetic lube base oil having an Oxidator A value of greater than about 5 and an Oxidator BN value of less than about 10;

wherein the lube base oil has an Oxidator A value of greater than about 5 and has an Oxidator BN value of greater than about 10.

11. A lube base oil according to claim 1 wherein the oil has an oven storage stability of greater than 90 days when measured at 150° F.

12. A lube base oil according to claim 1 wherein the synthetic oil is used in an amount of about 50% to about 99% and the non-synthetic oil is used in amount of about 50% to about 1%.

13. A lube base oil according to claim 1, wherein the lube base oil has an Oxidator A value of greater than about 5 and an Oxidator BN value of greater than about 10.

14. A lube base oil according to claim 13, wherein the lube base oil has an Oxidator A value of greater than about 10.

* * * * *